US005203086A

United States Patent [19]

Dann

[11] Patent Number: 5,203,086

[45] Date of Patent: Apr. 20, 1993

[54] CUTTING APPARATUS

[75] Inventor: Michael Dann, Philadelphia, Pa.

[73] Assignee: Hunt Holdings, Inc., Wilmington, Del.

[21] Appl. No.: 853,446

[22] Filed: Mar. 18, 1992

[51] Int. Cl.[5] ..... B26B 1/08

[52] U.S. Cl. ..... 30/293; 30/162; 30/294; 30/335

[58] Field of Search ..... 30/152, 162, 294, 286, 30/287, 289, 293, 335, 336, 340, 342, 317, 305, 304

[56] References Cited

U.S. PATENT DOCUMENTS

| | | | |
|---|---|---|---|
| 715,646 | 12/1902 | Driscoll . | |
| 886,750 | 5/1908 | White | 30/293 |
| 1,599,800 | 9/1926 | Van Sickel . | |
| 2,044,426 | 6/1936 | Gelleff | 30/293 |
| 2,215,216 | 9/1940 | Gits et al. | 30/162 |
| 2,467,327 | 4/1949 | McKee | 30/294 |
| 2,924,010 | 2/1960 | Umholtz | 30/293 |
| 3,394,457 | 7/1968 | Holder | 30/294 |
| 3,448,519 | 6/1969 | Tobias | 30/293 |
| 3,478,427 | 11/1969 | Tims, Jr. | 30/294 |
| 3,724,071 | 4/1973 | Hurtubise | 30/294 |
| 3,772,785 | 11/1973 | Fischer | 30/293 |
| 3,893,238 | 7/1975 | Scholl | 30/289 |
| 3,991,467 | 11/1976 | Yokoyama | 39/293 |
| 4,031,616 | 6/1977 | Hines et al. | 30/2 |
| 4,048,719 | 9/1977 | Thompson | 30/2 |
| 4,064,626 | 12/1977 | Meshulam et al. | 30/287 |
| 4,262,419 | 4/1981 | Pierce | 30/293 |
| 4,281,458 | 8/1981 | Okada | 30/162 |
| 4,354,314 | 10/1982 | Pierce | 30/293 |
| 4,393,587 | 7/1983 | Kloosterman | 30/162 |
| 4,472,879 | 9/1984 | Sizemore, Jr. | 30/304 |
| 4,501,069 | 2/1985 | Kohno | 30/293 |
| 4,578,865 | 4/1986 | Keller | 30/335 |
| 4,866,847 | 9/1989 | Batrack et al. | 30/293 |
| 4,897,920 | 2/1990 | Dunbar | 30/90.4 |

*Primary Examiner*—Frank T. Yost
*Assistant Examiner*—Hwei-Siu Payer
*Attorney, Agent, or Firm*—Synnestvedt & Lechner

[57] ABSTRACT

A hand-held cutter especially for mat or foam board comprises a body, with handle, carrying a sliding blade holder so that a cutting blade mounted on it can be extended for cutting, or withdrawn for safety when not in use; the holder is adapted to carry two parallel, spaced-apart blades when it is desired to make two parallel cuts in a board, and the body has an inclined-plane nose so the region between the two cuts can be "plowed out" to form a channel for receiving another piece of foam board. Each blade is mounted on an outboard side of the body so the blade and cut line can be easily seen during use. A clip-on angulation device is provided which, when clipped onto the bottom of the main body, provides an angled guide surface on which the body can be slid, when an angled cut is desired.

3 Claims, 3 Drawing Sheets 12
28
10
31
19
16
42
20
23
22

12
28
31
10
30
19
20
32
29
42
74
23

12
70
10
30
23
22
29
39
28
20
40
31
38
W
74
24
37
32
36
19
37
42
34

10
12
28
31
19
20
42
16

12
28
7
31
22
20
7
10
8
28
74
23
24
16
8
19
α
22

CUTTING APPARATUS

FIELD OF THE INVENTION

This invention relates to cutting apparatus such as hand-held knives, and especially to knives adapted to cut thin objects such as mat, although also effective in certain applications to the cutting of thicker objects such as foam board, for example.

BACKGROUND OF THE INVENTION

Cutting devices, or knives, of the type used to make a cut by drawing of the knife across the object to be cut are known in the art and are useful, for example, in the cutting of mat or of thicker material such as foam board. The knife normally has a body including some form of handle, a surface which runs along the work during the cutting process, and a blade having a cutting portion which can be extended outward from the body to various adjustable positions, depending upon the depth of cut desired. In some cases the surface beyond which the blade projects is relatively broad, so as to serve as a guide as the knife is being drawn, holding it at the desired lateral elevational angle with respect to the work, for example in a directly upright position. In some cases such knives contain arrangements for variably orienting the lateral elevational angle of the cutting tool with respect to the surface of the object to be cut, to produce cuts at various selected angles.

It is desirable that such a knife be small, light, compact and inexpensive, while at the same time providing cuts at the desired angle. It is also desirable that the knife be such that the path of the cut, and the cutting position, can be viewed by the user during the cutting operation, so that the cut can be made exactly in the desired position. In some cases it is desirable to be able to use the knife to form a groove in the work material, for example in foam board, so that another piece of material can be set with its edge in the groove, in a perpendicular or other position.

It is an object of the present invention to provide a cutting device or cutting apparatus providing and one or any combination of the above-described desirable features.

BRIEF DESCRIPTION OF THE INVENTION

These and other objects of the invention are achieved by the provision of cutting apparatus comprising a main body having a grip, a blade holder slideable on the main body and a cutting blade held in the blade holder for adjustable extension and retraction from the body, to the extent desired for the cutting to be performed; the body of the cutting device preferably has a planar guide surface along one edge thereof which assists in holding the body at a fixed elevation angle with respect to the surface of the material to be cut. The blade is preferably mounted so that the cutting portion thereof is outboard of the portion of the body adjacent to the cutting path, whereby the cutting path and cutting action are readily visible to the viewer, as an aid in providing the desired position of the cut.

In an embodiment preferred for certain purposes, a second blade is provided on the opposite side of the body from the first blade whereby, in a single pass, two parallel cuts can be made, for example in foam board. The body of the cutting apparatus is preferably provided with a portion of inclined-plane configuration so that after such parallel cuts have been made, the inclined-plane portion of the body can be used like a plow to remove material between the two cuts and form the desired groove.

In a another preferred embodiment, the knife is provided with a readily removable angulation attachment for holding the blade or blades at an angle other than normal to the surface of the material to be cut, e.g. at 45°, whereby a controlled angular cut can be made. In one preferred form, this attachment is readily snapped into and out of position on the body of the cutting device.

BRIEF DESCRIPTION OF FIGURES

These and other objects and features of the invention can more readily be understood from a consideration of the following details of description, taken in connection with the accompanying drawings, in which.

DETAILED DESCRIPTION OF THE SPECIFIC EMBODIMENTS

Considering now the preferred embodiment of the invention shown in the Figures, the cutting device shown comprises a body 10 having an elastomeric grip 12 for comfort in grasping and using it. The main body of the knife is in the shape of a plate having a substantial thickness W and extending at approximately 45° to the axis of the grip, so that the entire knife has the general shape of a small hand gun.

Figure 10:
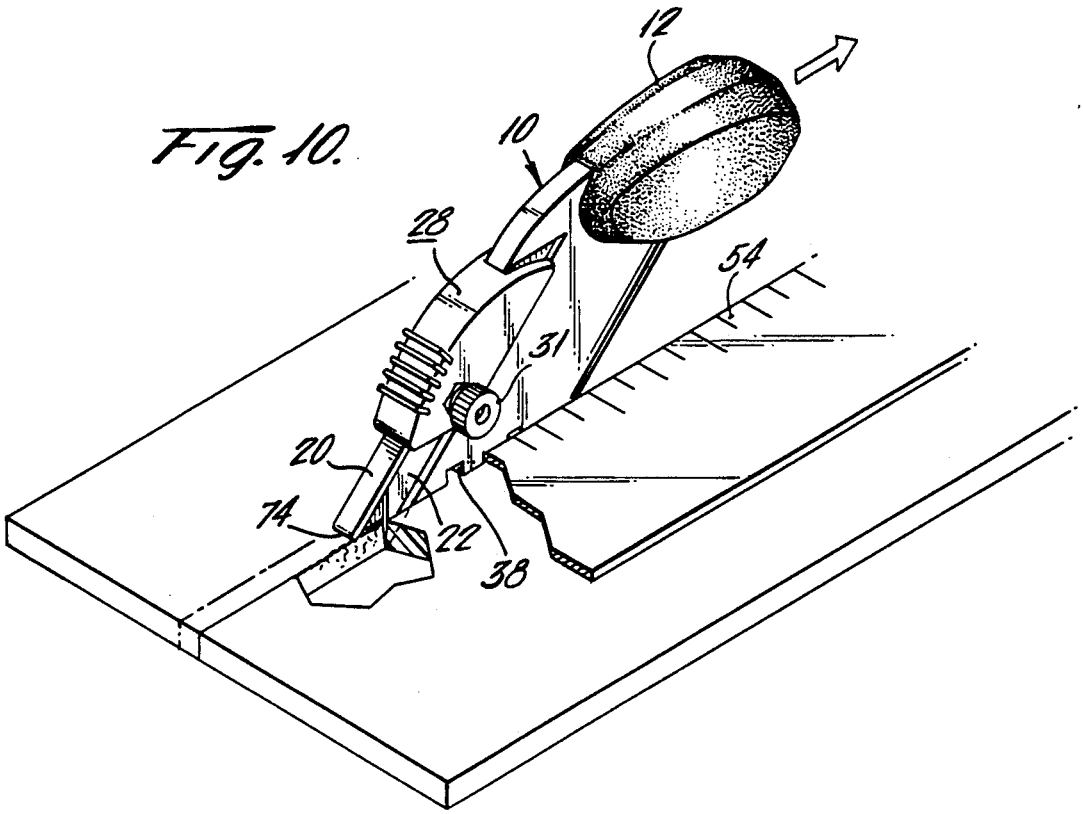
FIG. 10 is an isometric view of the cutting apparatus of the invention in the process of providing a vertical cut in a board.
Figure 11:
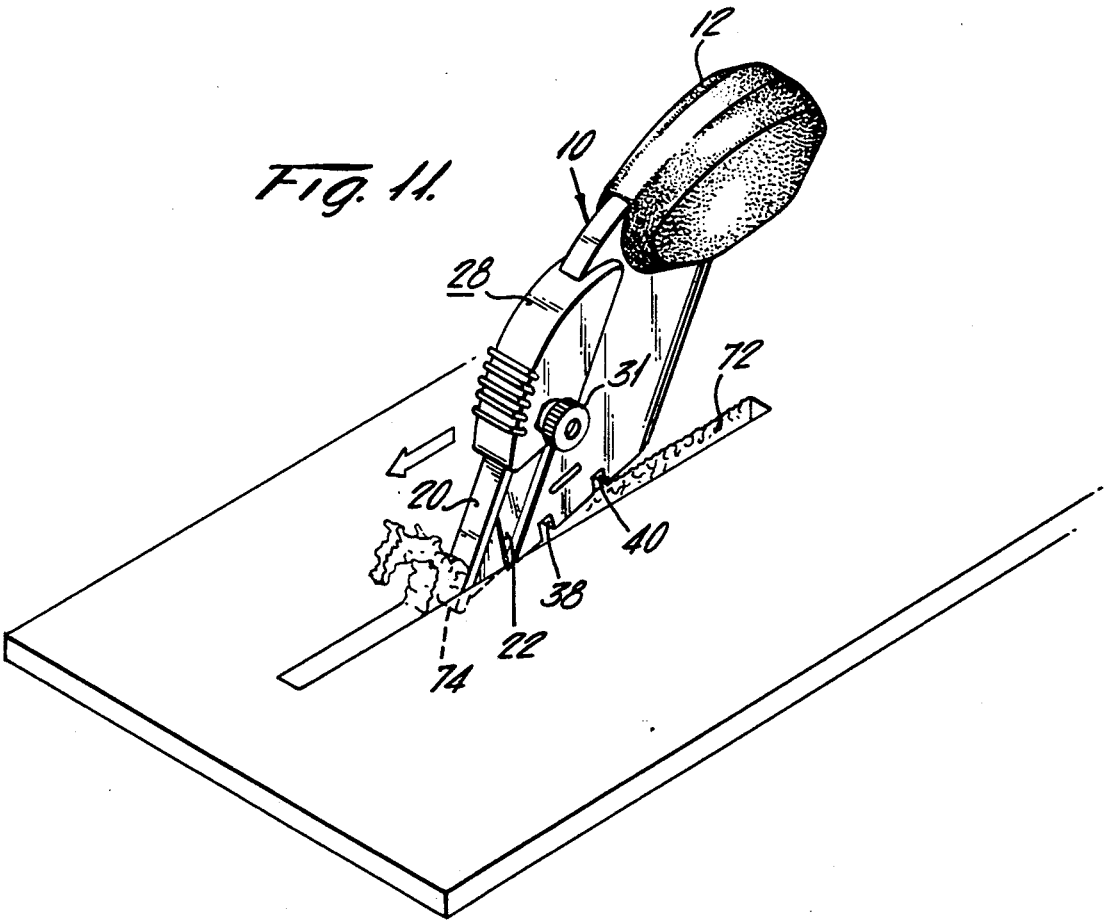
FIG. 11 is an isometric view of the board cutter being used to scoop out the foam material between two parallel cuts in a foam board.

The bottom edge 16 of the body is planar and perpendicular to the central plane of the body, thereby to form a substantial guide surface along which the knife can be drawn to stabilize it in its position at right angles to the surface of the work being cut when the angulation attachment 19 is removed as in FIGS. 10 and 11. The front end 20 of the knife body has the shape of an inclined plane, making it suitable for "plowing", or routing out, a groove in the material between two parallel spaced-apart cuts, as will be described more fully hereinafter.

Figure 1:
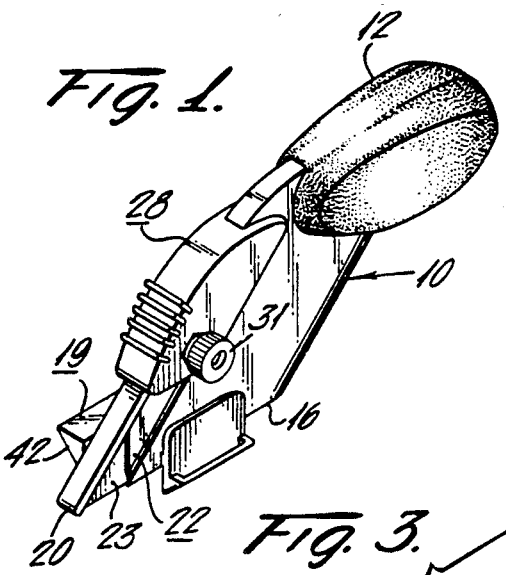
FIG. 1 is an isometric view of a preferred embodiment of cutting apparatus in accordance with the invention, showing a first side thereof.
Figure 2:
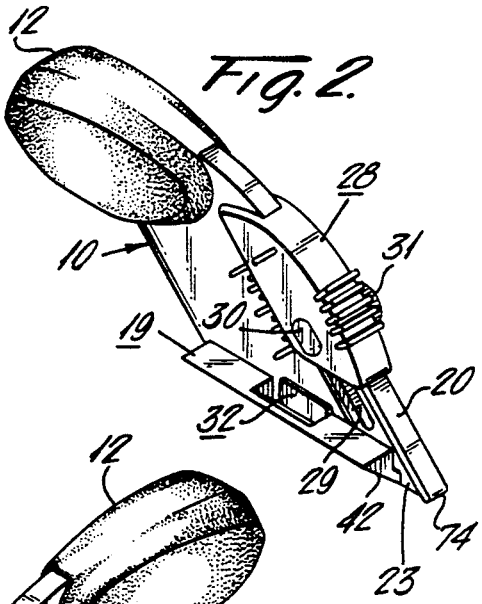
FIG. 2 is an isometric view of the cutting apparatus shown in FIG. 1 as viewed from its opposite side, showing additional details of the apparatus.
Figure 4:
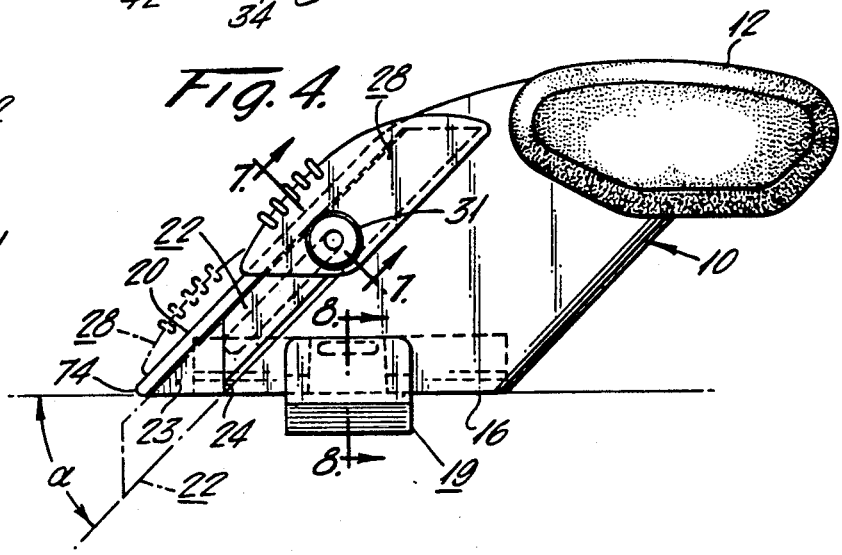
FIG. 4 is an enlarged side elevational view of the cutting apparatus of the invention.
Figure 6:
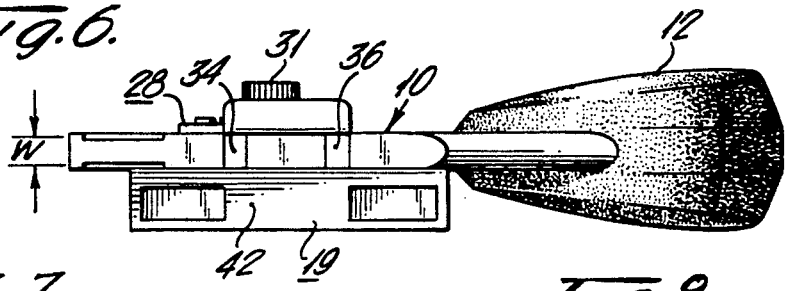
FIG. 6 is a bottom plan view of the cutting apparatus shown in FIG. 4.
Figure 7:
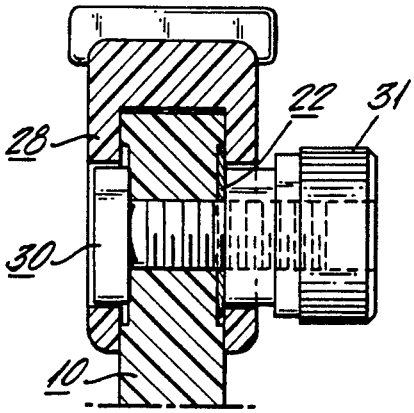
FIG. 7 is a greatly enlarged fragmentary sectional view taken on the line 7—7 of FIG. 4, showing details of the blade adjusting means.

The knife blade 22 lies in a blade-retention recess 23 in body 10, and a similar recess is provided on the other side of the body for another blade. Blade 22 has a cutting portion 24 at one end thereof, and is held in a slideably adjustable blade holder 28 mounted along the top edge of body 10, which permits it to be slid to a retracted position in which the cutting portion of the blade is entirely withdrawn within the outlines of the body as shown in FIG. 1, and an extended position, as shown in FIG. 4 in broken line, in which the blade extends from the body so that it will cut material along which the knife is drawn. A screw 30 extending through the blade holder and the body and a knurled nut 31 provide a clamping action; the nut is loosened to permit adjustment of the position of the blade holder, and then tightened to hold the blade in the selected position. Slot 29 permits, and limits the extent of, this sliding adjustment.

Figure 8:
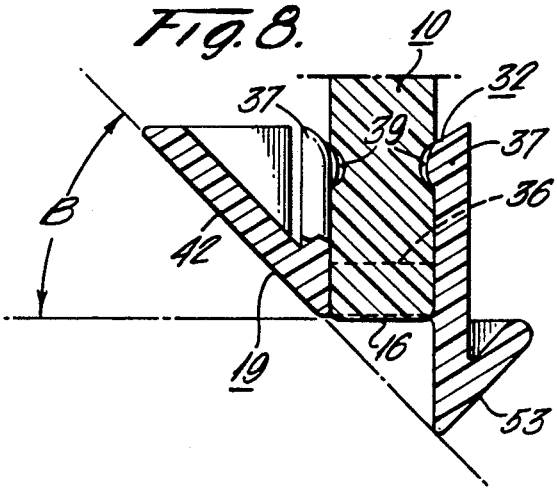
FIG. 8 is a greatly enlarged fragmentary sectional view taken on line 8—8 of FIG. 4.

The angulation device 19 is a snap-on device having a clip portion 32 which snaps on to the lower edge of body 10 and is held against longitudinal motion by two arms 34 and 36 which fit into corresponding recesses 38 and 40 in the body 10. Clamping fingers 37 snap into dimples 39 to provide the desired snap-on action. The angulation device includes a guide surface 42 on which the knife is rested as it is drawn along the material to be cut, when an angulated cut is desired. This angle is shown a B in FIG. 8, and a 45° angle is typical.

Figure 9:
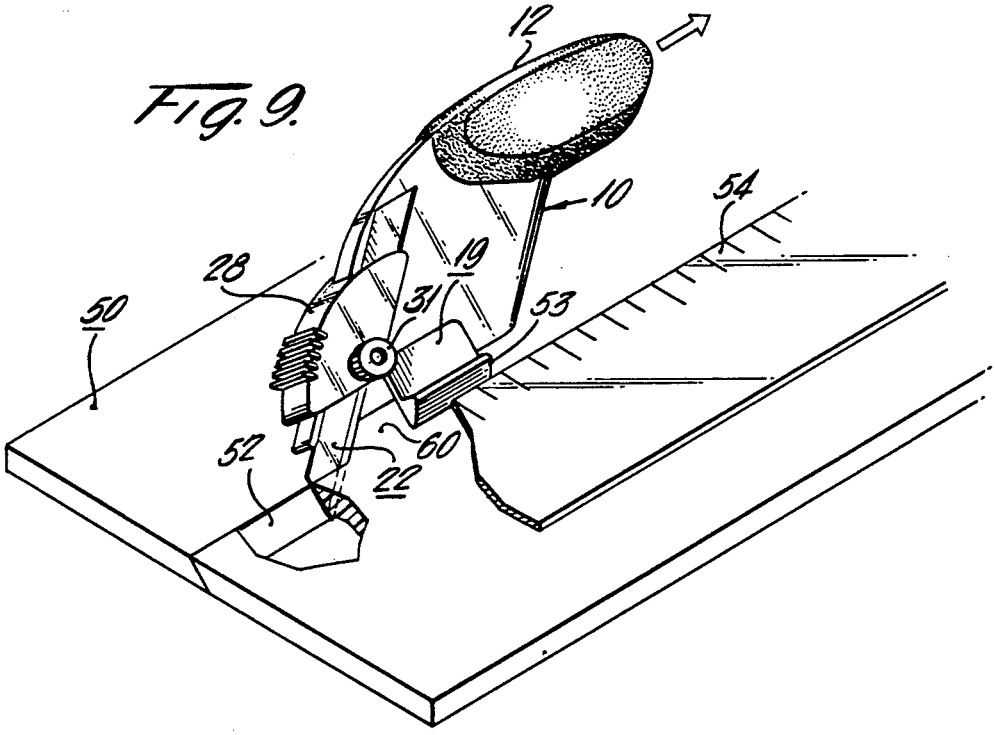
FIG. 9 is an isometric view of the cutting apparatus of the invention equipped with the snap-on, 45° angle, cutting attachment, making a 45° bevel cut in a board.

FIG. 9 shows this embodiment of the invention in use in cutting a mat 50 at a 45° angle. The knife is positioned as shown, and then drawn in the direction of its handle to form the cut 52, with angulated guide surface 42 lying flat against the top of the mat 50 so as to assist in holding the blade at 45° during the cutting operation. During such operation, the turned-up flange 53, which extends perpendicularly to the guide surface 42, may be used as a guide in moving the cutter along a straight edge 54, for example.

As will appear from the drawings, the blade is mounted outboard of the body 10, so that the region of cutting contact 60 of the blade with the work is not beneath the body, and hence is readily visible to the user so he can see exactly where the cut is being made, and where the desired path of the cut lies.

During storage of the apparatus, the clamp screw 30 is loosened, the blade holder retracted fully so that the point of the blade no longer projects beyond the body 10, and the screw retightened to clamp the blade holder in that storage position. To use the knife, the clamp screw is loosened and the blade holder slid outwardly to project the point of the blade the desired distance beyond the body, in which position it is clamped by the screw; the knife is then held by the grip and drawn, in the handle direction, along the path on which the cut is to be made. When finished, the blade holder is again withdrawn and clamped in a safe storage position.

Figure 3:
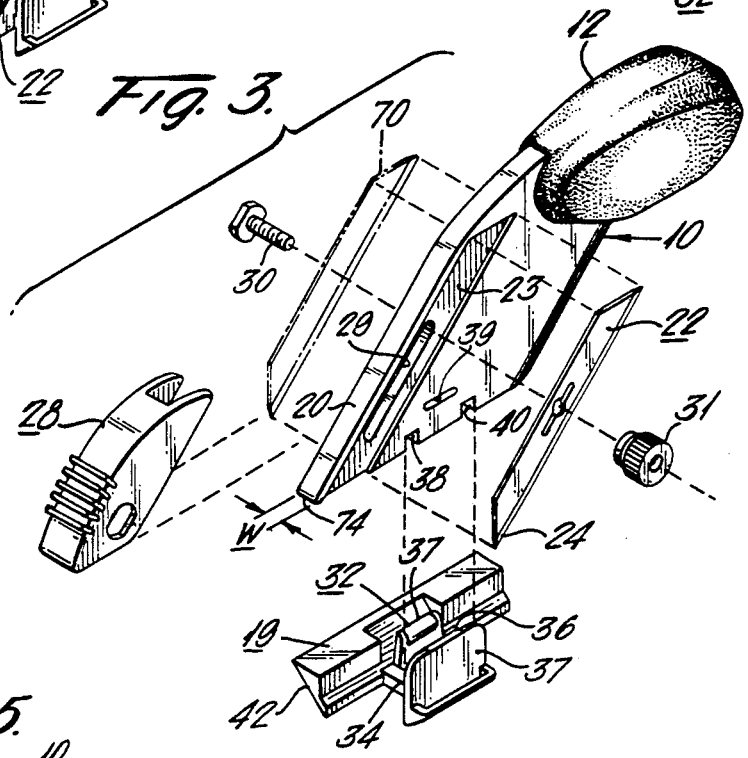
FIG. 3 is an isometric exploded view of the cutting apparatus shown in FIGS. 1 and 2, showing the component parts thereof.
Figure 5:
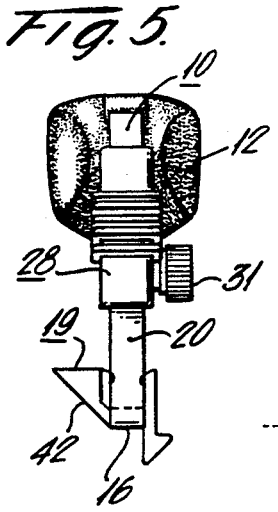
FIG. 5 is a front elevational view of the same cutting apparatus, as viewed from the left-hand side of FIG. 4.

FIGS. 10 and 11 show an alternative preferred embodiment suited for making spaced-apart parallel cuts, in this case vertical, or 90° cuts, which then can be plowed out to form a slot or groove. In this embodiment, there is added a second cutting blade 70 (see also FIG. 3), slideably mounted in the blade holder 28 with the aid of the clamping screw 30, similar to the arrangement for holding blade 22. As shown in FIG. 3, when two parallel cuts are to be made, both blades are clamped in extended position and drawn along the work (see FIG. 10). As further shown in FIG. 11, a channel or groove 72 between the cuts can then readily be made, especially in the case of foam board, as an example, by placing the nose 74 of the inclined portion 26 of the cutter, with both blades retracted, into the region between the cuts and pushing it forwardly in a plowing action to remove the material between the cuts to the depth of the cuts. This permits ready insertion of another foam board of similar thickness into the slot thus formed.

In the latter example, the point of contact of the cutting blade with the work piece is again outboard of the body of the cutter, so that the cutting action and cutting path can readily be seen by the user.

There has therefore been provided a cutting apparatus which permits making a perpendicular cut, or another selected angle of cut, by use of an easily mountable and demountable attachment, while permitting the user to monitor visually the point of cutting and the path along which the cutting is proceeding. Provision is also included for making two parallel cuts in a similar manner, and for removing the material from between the cuts to form grooves. These features are provided in a simple, small, economically-producible unit especially adapted for cutting mat and foam board.

While the invention has been described with particular reference to specific embodiments in the interest of complete definiteness, it will be understood that it may be embodied in a variety of forms diverse from those specifically shown and described, without departing from the spirit and scope of the invention as defined by the appended claims.

I claim:

1. Apparatus for making narrow, slitlike cuts extending along a cutting path in a material, comprising:

a blade-holding body having a grip portion adapted to be held in a hand of a user to enable drawing of said body along a predetermined cutting direction parallel to said cutting path;

a blade holder mounted on said body;

an adjustable cutting blade having a cutting edge and held in said blade holder for adjustable extension of said cutting edge into a cutting position in which it protrudes outward beyond an edge of said body and for retraction into a stored position in which it is entirely within the border of said body, the plane of said cutting blade and the plane of said cutting edge extending along said predetermined cutting direction;

said body having a planar guide surface at said edge thereof for holding said body at a fixed elevational angle with respect to the surface of said material adjacent thereto as said body is moved along said surface of said material to effect cutting of said material along said cutting path by said cutting edge of said blade;

said blade being mounted on an outer side of said body parallel to said cutting path so that it is readily visible to a viewer, another cutting blade having a cutting edge and held in said blade holder for adjustable extension and retraction of its cutting edge with respect to said edge of said body, said another blade being held for sliding motion parallel to and on the opposite side of said body from said first-named blade, whereby both blades may make simultaneous cuts, wherein said another blade and said first-named blade are spaced apart by the thickness of said body, and said body has a nose portion extending between said blades and having an inclined-plane configuration, whereby after said cuts are made, said body portion can be moved along between said cuts to plow out the material between said cuts.

2. Apparatus for making narrow, slitlike cuts extending along a cutting path in a material, comprising:

a blade-holding body having a grip portion adapted to be held in a hand of a user to enable drawing of said body along a predetermined cutting direction parallel to said cutting path;

a blade holder mounted on said body;

an adjustable cutting blade having a cutting edge and held in said blade holder for adjustable extension of said cutting edge into a cutting position in which it protrudes outward beyond an edge of said body and for retraction into a stored position in which it is entirely within the border of said body, the plane of said cutting blade and the plane of said cutting edge extending along said predetermined cutting direction;

said body having a planar guide surface at said edge thereof for holding said body at a fixed elevational angle with respect to the surface of said material adjacent thereto as said body is moved along said surface of said material to effect cutting of said material along said cutting path by said cutting edge of said blade;

said blade being mounted on an outer side of said body parallel to said cutting path so that it is readily visible to a viewer, another cutting blade having a cutting edge and held in said blade holder for adjustable extension and retraction of its cutting edge with respect to said edge of said body, said another blade being held for sliding motion parallel to and on the opposite side of said body from said firstnamed blade, whereby both blades may make simultaneous cuts; and an angulation attachment securable to said body and having an angulated guide surface extending at an oblique angle to the plane of said guide surface of said body, whereby a cut can be made at an oblique angle to said plane of said guide surface by sliding said body along on said angulated guide surface with said blade extended.

3. The invention as claimed in claim 2, comprising snap-attachment means on said angulation attachment and on said body, to permit easy attachment and detachment of said angulation attachment.

* * * * *